US012083386B2

(12) United States Patent
Voje et al.

(10) Patent No.: US 12,083,386 B2
(45) Date of Patent: Sep. 10, 2024

(54) UNDERWATER SCOOTER FOR DIVERS

(71) Applicant: Oceanus, Podvodna Fotografija, Andrej Voje S.P., Moravce (SI)

(72) Inventors: Andrej Voje, Moravce (SI); Robert Kunc, Ljubljana Polje (SI)

(73) Assignee: Oceanus, Podvodna Fotografija, Andrej Voje S.P. (SI)

( * ) Notice: Subject to any disclaimer, the term of this patent is extended or adjusted under 35 U.S.C. 154(b) by 82 days.

(21) Appl. No.: 17/264,181

(22) PCT Filed: Aug. 5, 2019

(86) PCT No.: PCT/SI2019/050014
§ 371 (c)(1),
(2) Date: Jan. 28, 2021

(87) PCT Pub. No.: WO2020/036540
PCT Pub. Date: Feb. 20, 2020

(65) Prior Publication Data

US 2021/0154532 A1 May 27, 2021

(30) Foreign Application Priority Data

Aug. 13, 2018 (SI) ..... P-201800177

(51) Int. Cl.
*A63B 35/12* (2006.01)
*B63C 11/02* (2006.01)

(52) U.S. Cl.
CPC ..... *A63B 35/12* (2013.01); *B63C 11/02* (2013.01); *B63C 2011/028* (2013.01)

(58) Field of Classification Search
CPC ..... A63B 35/12; A63B 35/125; B63C 11/02; B63C 2011/028
USPC ..... 114/114, 315
See application file for complete search history.

(56) References Cited

U.S. PATENT DOCUMENTS

| | | | | |
|---|---|---|---|---|
| 7,270,074 | B2 | 9/2007 | Pradetto et al. | |
| 7,654,215 | B2 | 2/2010 | Vitale | |
| 9,315,248 | B2 * | 4/2016 | Williams | B63B 73/20 |
| 10,093,403 | B2 * | 10/2018 | Williams | B25J 9/08 |

(Continued)

OTHER PUBLICATIONS

International Search Report for PCT/SI2019/050014.
Written Opinion for PCT/SI2019/050014.

*Primary Examiner* — Daniel V Venne
(74) *Attorney, Agent, or Firm* — Voyer Law

(57) ABSTRACT

The present invention belongs to the field of equipment for living or working underwater, more precisely to the field of diving equipment, especially underwater propulsion vehicles for divers. The object of the invention is an underwater scooter for divers. The essence of the underwater scooter for divers is in that the thruster is placed above the scuba diving tank when used and below it when it is not used. The interchangeable battery pack is placed around the scuba dive tank. The thruster rotation between both positions is enabled by contact hinge which connects the thruster and the interchangeable battery pack. By holding the command joystick in his/her hand the diver is managing the device. There is a safety cord with karabiner snap hook attached to the command joystick which could be attached to the scuba diving inflated life jacket. Thus, the diver is able to steer the device hands-free.

15 Claims, 5 Drawing Sheets

(56) References Cited

U.S. PATENT DOCUMENTS

Figure 1:
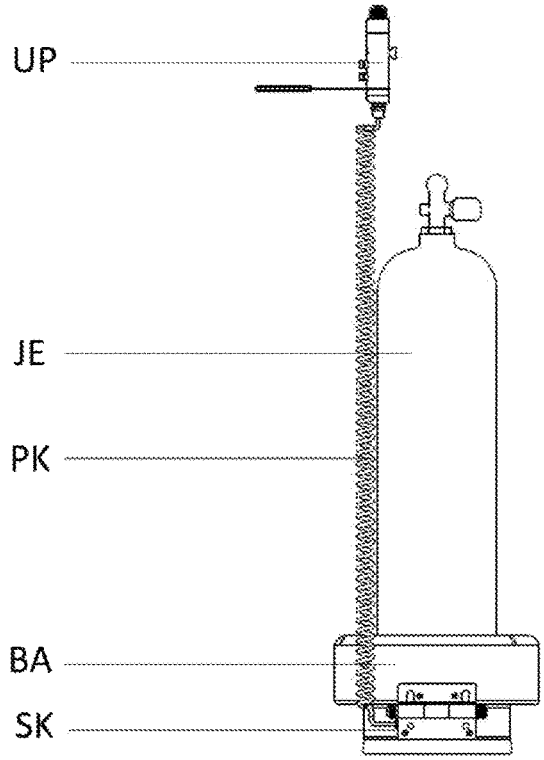

| | | | |
|---|---|---|---|
| 2008/0072812 | A1 | 3/2008 | Vitale et al. |
| 2009/0056613 | A1 | 3/2009 | Vitale |

* cited by examiner

UNDERWATER SCOOTER FOR DIVERS

FIELD OF THE INVENTION

The present invention belongs to the field of equipment for living or working underwater, more precisely to the field of diving equipment, especially underwater propulsion vehicles for divers. The object of the invention is an underwater scooter for divers.

BACKGROUND OF THE INVENTION AND THE TECHNICAL PROBLEM

During diving, divers depend on limited air stock stored in their scuba dive tanks. Smaller air consumption enables longer and/or much safer dives. Air consumption depends on diver's activities in the water and/or on the circumstances such as unpredictable underwater currents, depth, bad visibility, low water temperature etc. Among diver's activities in the water, swimming with legs and fins represents the main contribution to air consumption. In order to decrease air consumption a device, which pushes the diver forwards, had been invented a few decades ago. This device is called an underwater propulsion vehicle or underwater scooter and enables longer and safer dives.

However, despite their functionality, underwater scooters are large and need a lot of storage space, while also their use could be more user-friendly, as the diver still needs at least one hand to hold and/or manage the scooter. The technical problem solved by the present invention is the construction of a scooter that will allow safer and easier managing and steering of diving direction below the surface. Further, the improved scooter should reduce the storage place on diver's boats. The aim of the invention is to ensure safer, more comfortable and longer dives and consequently smaller air consumption.

STATE OF THE ART

Currently available underwater scooters for divers use one of following main approaches:

1. The diver holds the underwater scooter in his/her hands with both hands (sometimes with one hand only). The underwater scooter pushes the diver forwards. An example of such approach is disclosed on the link https://www.suex.it/. Such devices are clumsy, huge, heavy and very often it is not possible to interchange the battery pack. Since the charging time is usually much longer than the time interval between two or more successive dives, it is not possible to use such a device on many successive dives on the same day. Another problem with such devices is the storage place on diving cruisers or boats. Available storage space on diving cruisers or boats is limited and therefore there is no chance to use such underwater scooters by more divers on the diving cruisers or boats. Usually, the capacity of diving cruisers is up to 20 divers and the capacity of diving boats is up to 10 divers.
2. A similar solution is shown at https://seabob.com/modelle-ausstattung/, where the diver also holds the underwater scooter in his/her hands with both hands and the device pushes the diver forwards. This device is even more clumsy, huge, heavy than the solution of mentioned in paragraph Nr.1, so they need even more storage space. Such devices also have the above-described problem with charging.

3. A different approach is to install the underwater scooter along the diver's legs, while the battery pack is installed around the diver's waist. An example can be seen on http://www.patriot3.com/maritimeproducts/p3m_jetboots. These devices are mainly used by the military divers and are due to this reason not suitable for commercial divers.
4. Another possible approach is to install the underwater scooter along with the diver's scuba dive tank which is placed on the divers back as shown on http://pegasus-thruster.com/. This device is innovative in the sense of steering of diving in the water with slight movements of various human body parts e.g. shoulders or head. For managing the scooter, the diver holds a command stick in his/her hand, the command stick is connected to the scooter by a cable. The usage of an interchangeable battery pack is available with this device. Such an approach enables the diver to use the scooter on more successive dives during one day. However, many problems remained unsolved even by this approach, such as:
   a. the bottom of its thruster i.e. propeller is always placed below the bottom of the scuba dive tank, thus the diver is not able to install this underwater scooter by himself/herself when preparing for the dive i.e. putting the scuba life jacket together with scuba dive tank and underwater scooter on his/her back. The diver has to put the scuba life jacket together with scuba dive tank on his/her back first and afterwards, he/she needs the assistance of the third person who installs him/her the and underwater scooter on the scuba dive tank before jumping into the water. Due to the same reason, the diver needs assistance from the third person when he/she returns back from the water to the surface. Not earlier than the third person releases the underwater scooter from the scuba dive tank the diver is able to remove the scuba life jacket together with scuba dive tank from his/her back on a safe manner.
   b. it is not possible to store this underwater scooter together with scuba dive tank in the racks for scuba dive tanks designed for this purpose on the diving cruiser and/or diving boat. Consecutively this underwater scooter must be stored separately and thus additional place is needed. As mentioned above, storage space is very limited on diving cruisers and/or diving boats.
   c. due to the physical law, the installation of this underwater scooter's strap looks simple but is actually not. Namely, each diver must find out by himself/herself where exactly i.e. at which height of the scuba dive tank has to install the strap. The exact height depends on the diver's height. If the strap is not installed at the proper height, the diver will have problems to maintain the constant depth while diving. Most likely it will be pushed down to the depth or up to the surface. The concrete description of this problem is described at http://wetpixel.com/forums/index.php?showtopic=58399
   d. the command stick held in the diver's hand does not enable linear and/or step adjustable speed of underwater scooter (remark: adjustable speed is available at some other underwater scooters mentioned in point 1).
   e. the command stick held in the diver's hand does not enable different modes of operation i.e. running with a permanent press on the main button (enabled) or running without a permanent press on the main button (not enabled). The second option could be controlled by an electronic circuit to enable the same function as it is "cruise control" known in the car industry.

f. the command stick held in the diver's hand does not enable to control the remained capacity of the interchangeable battery pack e.g. the LED indicator.

Hence the diver does not know when the underwater scooter will stop running due to lack of energy in the interchangeable battery pack. The concrete description of this problem is described on this web link—paragraph 5 in the paragraph "Dislikes" http://wetpixel.com/forums/index.php?showtopic=58399

The device described in point 4 was disclosed in documents US20080072812A1, US20090056613A1, U.S. Pat. Nos. 7,270,074B2, 7,654,215 and 7,654,215B2. Its disadvantages are listed in points 4.a to 4.f. The present invention solves all above-mentioned imperfections and disadvantages of said devices.

Description of the Solution of the Technical Problem

The essence of the invention is in that the underwater scooter is mounted on the bottom of the scuba dive tank, where it does not consume a lot of space and where it does not compromise the diver's movement. The said scooter comprises a motor with a propeller, movably installed on the bottom part of the scuba dive tank with a hinge, and a control unit, which is held by the diver or is attached to the diving suit, wherein the control unit is connected to the scooter with a cable. The scooter has two positions, one active and one inactive, the latter being below the diving tank where it is not in use. The active position is achieved by movement of the propeller, as it begins to push the water away upon activation with the control unit. When it reaches the position above the scuba dive tank, the scooter allows movement of the diver. The active position is locked with a locking mechanism, which is preferably in the form of pins or screw balls engaging with grooves.

The underwater scooter according to the invention solves the problem of simplified steering of diving in the planed direction below the water surface. The installation and use of the scooter are simple and thus suitable for use by each diver. Due to its specificity as e.g. compact design and hands-free operation, it is especially suitable for use by following divers groups:

- for all divers on the diving cruisers or boats, since the device does not require any additional place for storage, because the thruster (SK) of the device is placed below the scuba dive tank and interchangeable battery pack (BA) is placed around the scuba dive tank when not running,
- for rescue divers who have to find the victim during the rescue activities as fast as possible and need free hands during their activities,
- for disabled divers who are paralyzed from the waist down and can use their hands only and not their legs and fins while diving. When using this device, which is the object of this patent, the disabled divers are on a par with other divers,
- for divers in advanced years, who are in good health for diving but they are not fit enough for intensive swimming e.g. while strong underwater currents appear,
- for underwater videographers and photographers who need free hands to catch their video and/or photo equipment in their hands,
- for all other divers who perform different hard work in the water e.g. underwater archaeologist.

Figure 2:
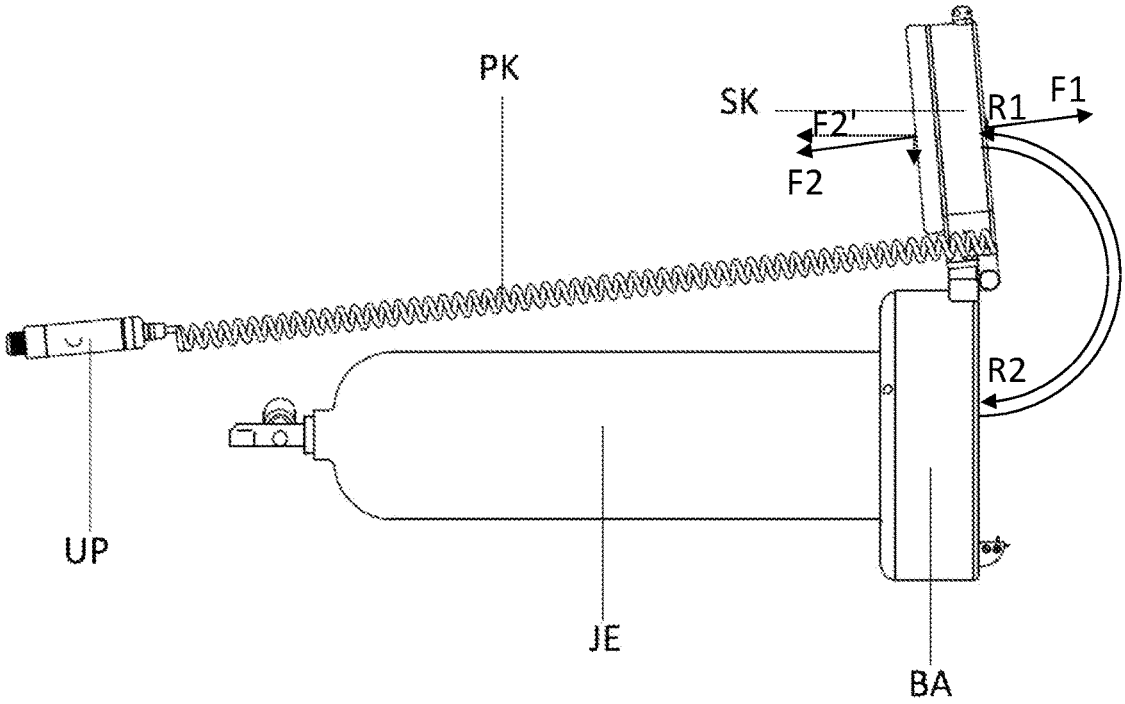
Figure 3:
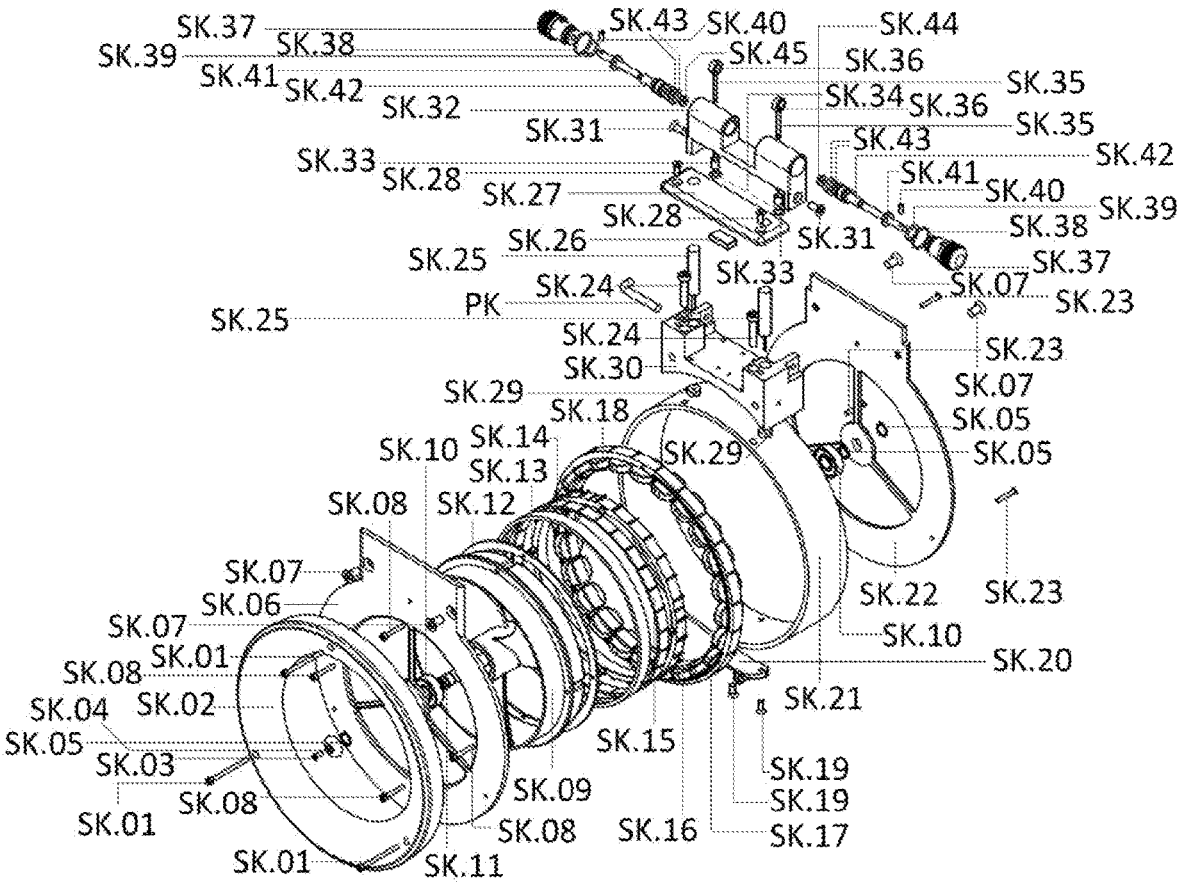

The invention will be described in further detail based on possible embodiments and figures, which show:

FIG. 01: the underwater scooter installed on the scuba dive tank during inactive or storage phase FIG. 02: the underwater scooter installed on the scuba dive tank during active phase FIG. 03: longitudinal section of thruster (SK)

Figure 4:
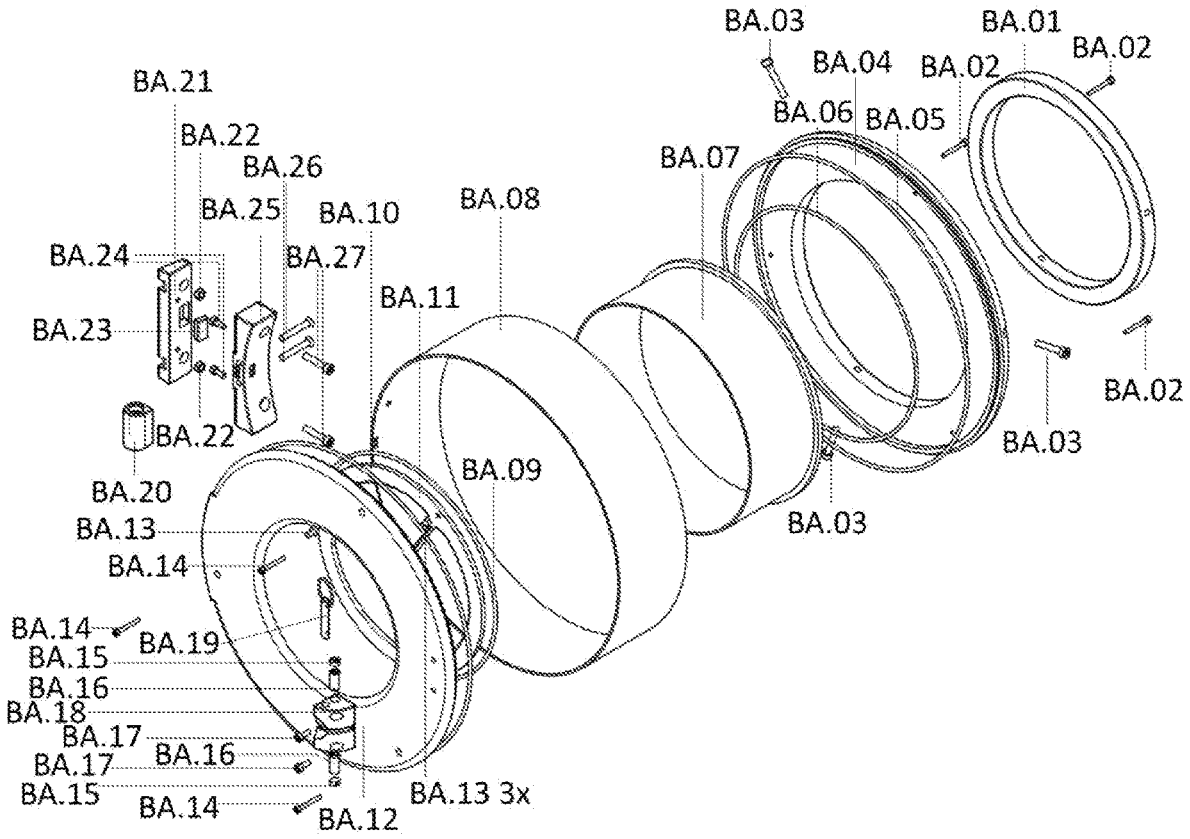

FIG. 04: longitudinal section of the interchangeable battery pack (BA)

Figure 5:
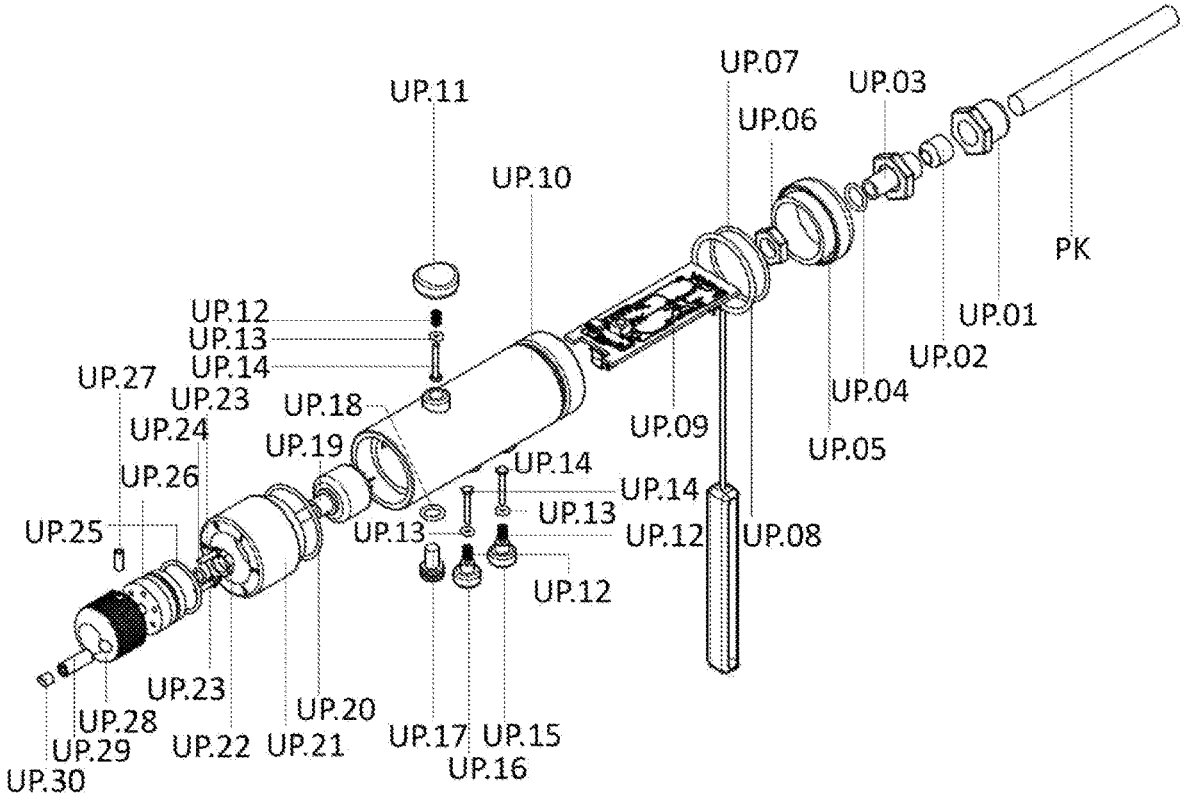

FIG. 05: longitudinal section of command joystick (UP)

Figure 6:
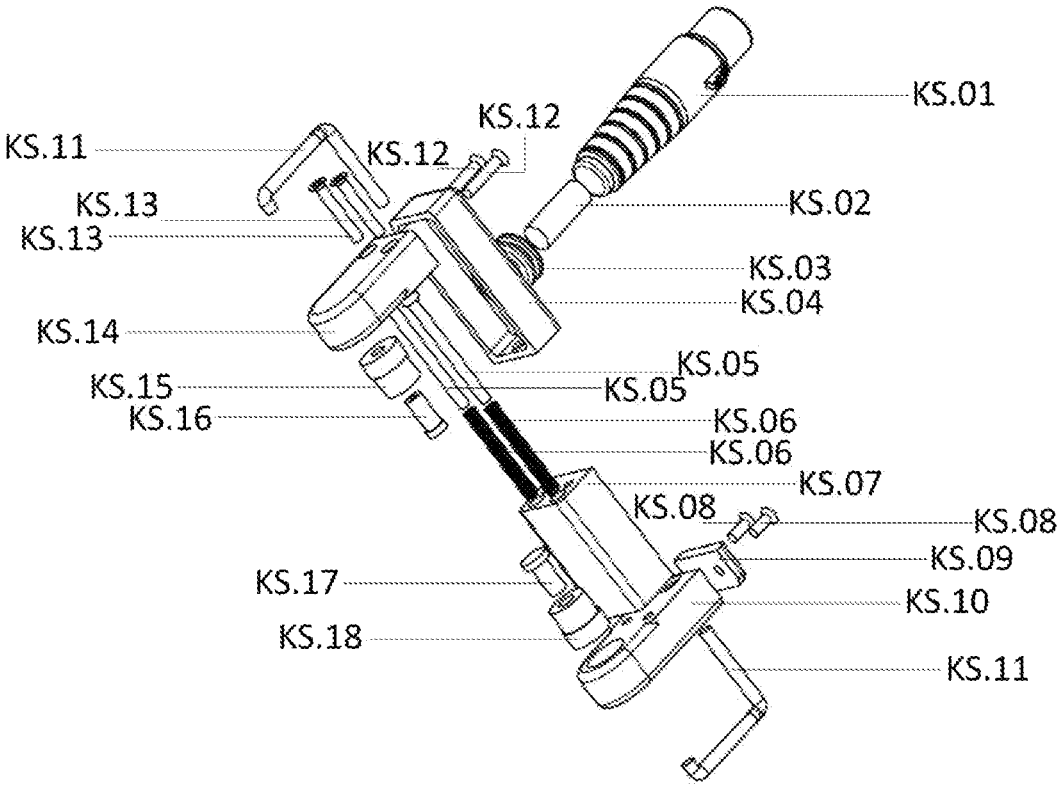

FIG. 06: longitudinal section of contact clamp (KS)

The underwater scooter comprises a thruster (SK), an interchangeable battery pack (BA), a connection cable (PK) and a command joystick (UP). FIG. 01 shows the underwater scooter mounted on the scuba dive tank (JE) in the inactive position i.e. non-use position (vertical setting up) and FIG. 02 shows the underwater scooter mounted on the scuba dive tank (JE) in the active position of use. The pushing force F2 of the propeller assures in its acting direction the motion/rotation R1 of the thruster (SK) into the active position of use while the pushing force in the opposite direction assures the motion/rotation R2 into the inactive position i.e. non-use position. With the engine rotation of the thruster (SK) in the active position of use, the resultant pushing force appears in the screw axis respectively along the arrow of force F1. Due to the thruster position, which is outside the diver's axis, the device is pushing the diver in the direction of arrow force F2' which is parallel with the scuba dive tank (JE) axis respectively the diver's axis. The scuba dive tank (JE) is a part of standard diving equipment. The scuba dive tank (JE) is fixed with one or two straps which are/are part of the scuba dive jacket. Scuba dive jacket is a part of standard diving equipment as well.

Thruster (SK)

All components of the thruster (SK) are shown in FIG. 03. The brushless electric motor has a stator (SK.18), wherein on its circumference copper coils (SK.17) are provided, while a rotor ring (SK.16) with magnets (SK.15) is installed inside the stator (SK.18). This type of a brushless electric motor is known as "out runner" and is used in many different applications. A propeller (SK.09) is provided inside the rotor ring (SK.16). There are two different solutions available on the market:

- axial solution, where the propeller has the axle in the middle, which assures rotation; an example of such a solution is available on this web link—http://www.t-sltechnology.com/marine/thrusters.htm
- non-axial solution, where the propeller has no axle in the middle, instead the propeller blades are fixed to the inside circumference of the rotor; an example of such a solution has been disclosed at this web link—https://www.copenhagensubsea.com/vl In the brushless electric motor, used in the underwater scooter the axial solution is used.

Stator (SK.18) and rotor ring (SK.16) comprises the appropriate iron lamellas made of the transformer sheet metal. To prevent corrosion, stator (SK.18) may be protected with epoxy powder coating and the rotor ring (SK.16) may be protected with the same coating having a suitable thickness. Magnets (SK.15) are fixed to the rotor ring (SK.16) with fixing elements such as pins and/or suitable bonding glue. The propeller (SK.09), which is made of technical plastic, is fixed with screws (SK.08) and nuts (SK.13) via aluminium ring (SK.12) to the rotor ring (SK.16). The ceramic bearings (SK.10) assure a bearing arrangement. The axle (SK.11) made of stainless steel is placed in the centre hole of the propeller (SK.09). The outside aluminium ring (SK.21), which protects the motor against any outside impacts, sticks to the protection covers (SK.06 and SK.22) made of aluminium.

The duct (SK.02) with an appropriate profile to increase the efficiency of the propeller by sucking in more water and made of technical plastic is fixed to the protection cover (SK.06) with screws (SK.01). Rigid integration of axial assembly is assured with two snap rings (SK.05), which prevent movement of ceramic bearings (SK.10) along the axis of axle (SK.11). Aluminium ring (SK.04) is fixed via a screw (SK.03) with the axle (SK.11). Protection covers (SK.06 and SK.22) are fixed with screws (SK.07) on the holder (SK.30) made of technical plastic. The whole complex of propeller, electric brushless motor and outside aluminium ring (SK.21) is fixed via two screws (SK.24) to the holder (SK.30).

The aluminium holder cover (SK.27) is fixed with the holder (SK.30) by two screws (SK.24). The contact hinge (SK.32) made of technical plastic is fixed with the holder (SK.30) by two screws (SK.31). Two brass rings (SK.36) are inserted into the hinge hole from the outside. Two brass conductors (SK.35) are inserted into the contact hinge (SK.32) holes from the bottom and screwed with brass rings (SK.36). Two contact brass discs (SK.44 and SK.45) are inserted from the inside of the contact hinge (SK.32) together with plastic insulating sleeves (SK.42), two o-rings (SK.43) and a brass conductor (SK.41). From the outside of contact hinge (SK.32) holes the plastic knob (SK.37) with two o-rings (SK.38 and SK. 39) is inserted and connected by screwing of a screw (SK.40) with a brass conductor (SK.41).

The brass ring (SK.36) has two functions—first is to block the brass conductor (SK.41) with plastic insulating sleeves (SK.42) inserted from the inner side of the contact hinge (SK.32), due to which the user is never able to completely unscrew the plastic knob (SK.37) from the contact hinge hole (SK.32).

The second function of the brass ring (SK.36) is to provide the contact with the brass conductor (SK.41) when the user is installing thruster (SK) with interchangeable battery pack (BA) and thus screwing clockwise the plastic knob (SK.37). At a certain point, the wider part of the brass conductor (SK.41) will stick with the brass ring (SK.36). Now the electrical contact established between the brass ring (SK.36), brass conductor (SK.41), brass contact disc (SK.44 respectively SK.45) on one side and on the other side with spring contact in the battery pack connector (BA.20). The described installation method assures that user is not able to unscrew (pull out) the contact conductor till the end thus preventing the fault installation of thruster (SK) with interchangeable battery pack (BA).

The connection cable (PK) is inserted via hole on the holder (SK.30) and connected with the electronic circuit of the motor controller, which is connected with internal wires to brass conductors (SK.35), which are waterproof and protected with o-rings (SK.34) and plastic insulating sleeves (SK.33). The wires connecting the copper stator coils (SK.17) with the electronic circuit of the motor controller of the brushless direct current motor (BLDC) are inserted via the dedicated hole in the holder (SK.30) and outside aluminium ring (SK.21).

Shock-absorbing rubber is provided on the battery pack (BA) to absorb the stroke when stopping the rotation when switching on the device and thus turning the thruster (SK) around the contact hinge (SK.32) from the inactive position to the active position. Consequently, it prevents jerky sticking of holder cover's upper surface (SK.27) with the upper surface of interchangeable tilt plate (BA.21). An alternative solution could be implemented with hydraulic shock-absorbers (SK.25) which are fixed with screws (SK.29) from the bottom side to the holder (SK.30) via the centre hole with the screw. Their function is to absorb the stroke when stopping the rotation when switching on the device and thus turning the thruster (SK) around the contact hinge (SK.32) from the inactive position to the active position. Consequently, they are preventing jerky sticking of holder cover's upper surface (SK.27) with the upper surface of interchangeable tilt plate (BA.21).

The magnet (SK.26) is inserted in the groove from the bottom side of the holder cover (SK.27). The function of this magnet (SK.26) is to attract the opposite magnet (BA.23) installed in the interchangeable battery pack (BA) and thus enabling the immobility in the active position of thruster (SK).

Instead of said magnets suitably shaped pins or screw balls can be used in order to lock the position, as the pins or screw balls interlock in grooves provided in an adapter holder (BA.25) of the battery pack. The connection between the pins or screw balls can be released upon selecting "inactivate" button on the command joystick (UP), wherein the motor starts to rotate in the opposite direction thereby forcing the pins or screw balls to leave the said grooves.

The locking plate (SK.20) with two holes is fixed with two screws (SK.19) to the outside aluminium ring (SK.21). The bigger hole is intended for the quick release pin with spring ball (BA.19), which prevents the thruster (SK) to be moved from its inactive position. The quick-release pin with spring ball (BA.19) is inserted via holes in the locking part (BA.18). The balls of spring plungers (BA.16) get stuck in the smaller hole of the locking plate (SK.20). When the quick release pin with spring ball (BA.19) is removed and the device is switched on, the tangent force as the consequence of propeller (SK.09) rotation pushes both balls of spring plungers (BA.16) to inside. As a consequence, the locking assembly is released and the thruster (SK) can change its position from the inactive position to the active position.

Contact cradles are parts of the thruster (SK). Each contact cradle comprises brass contact disc (SK.44 respectively SK.45), two o-rings (SK.43), plastic insulating sleeve (SK.42), brass conductor (SK.41), screw (SK.40) and plastic knob (SK.37) with two o-rings (SK.38 and SK.39). Both contact cradles differ only at a diameter of brass contact disc (SK.44 respectively SK.45); all other parts are identical. They both have the same function as well—to establish contact between the thruster (SK) and interchangeable battery pack (BA). Different diameters of brass contact disc (SK.44 respectively SK.45) prevent fault installation of thruster (SK) and interchangeable battery pack (BA). Further, it is not possible to install the contact clamp (KS) incorrectly and thus the battery charger to the interchangeable battery pack (BA).

The underwater scooter can operate in the water only. There are two stainless contacts inserted in the holder (SK.30) for safety reasons and connected with the electronic circuit of the motor controller. Once the diver jumps into the water due to its conductivity the electrical circuit between the stainless contacts and main electronic circuit of the motor controller is established thus enabling the underwater scooter to operate. While being on the surface pressing of any button on the command stick (UP) does not have any impact. For testing purposes on the surface, the above mentioned stainless contacts could be temporarily connected with the short cut connection. The main reason for such a solution is to prevent any child or adult person an unintentional activation of the underwater scooter.

Before installation of the device to the scuba dive tank (JE) it is necessary to screw the contact cradle until the brass contact disc (SK.44 respectively SK.45) sticks with the spring contact which is part of the battery pack connector (BA.20) of interchangeable battery pack (BA) and brass ring (SK.36). Brass conductor (SK.41) provides electrical contact with brass contact disc (SK.44 respectively SK.45) and brass ring (SK.36). Rubber o-rings (SK.43, SK.39, SK.38) assures waterproof of contact cradle. The plastic knob (SK.37) enables (un)installing of the interchangeable battery pack (BA) from thruster (SK) before/after (dis)assembling the underwater scooter to/from scuba dive tank (JE).

Interchangeable Battery Pack (BA)

The adapter ring (BA.01) is made of technical plastic is used when diver uses a scuba dive tank with standard diameter 171 mm. When the diver uses a scuba dive tank with standard diameter 203 mm the adapter ring (BA.01) is not needed. The adapter ring (BA.01) is mounted through its horizontal holes and horizontal holes on the battery pack cover (BA.04) with three screws (BA.03). The battery pack cover (BA.04) and the battery pack bottom (BA.12) are fixed with screws (BA.02 and BA.14). The interchangeable battery pack (BA) could be built from any type of cells however the most suitable cells are NiMH or Li-ion cells. Rubber o-rings (BA.05, BA.06, BA.09, BA.10) seal the housing of interchangeable battery pack (BA).

The inner ring of the battery pack (BA.07), the outer ring of the battery pack (BA.08), the battery pack bottom (BA.12) and the battery pack cover (BA.04) are component parts of housing of interchangeable battery pack (BA). They could be made of aluminium or technical plastic. The load-bearing ring (BA.11) bears the weight of the diving scuba dive tank thus it must be made of aluminium and is fixed to the battery pack bottom (BA.12) with screws (BA.13).

The locking part (BA.18) is fixed with screws (BA.17) to the battery pack bottom (BA.12). In the lower hole of the locking part (BA.18) two spring plungers with the ball (BA.16) are inserted. These two balls get stuck in smaller holes of locking plate (SK.20) when thruster (SK) and interchangeable battery pack (BA) are connected in the inactive position. The protection screws (BA.15) block the spring plungers with the ball (BA.16) thus assuring they are not moved due to any potential vibrations caused by operation of the device. The quick-release pin with spring ball (BA.19) is inserted in the upper hole of the locking part (BA.18) when the device is not in the operation mode.

The adapter holder (BA.25) is fixed to the outer ring of the battery pack (BA.08) with two screws (BA.27) and nuts (BA.22). The interchangeable tilt plate (BA.21) is fixed with two screws to the adapter holder (BA.25) where the magnet (BA.23) is inserted. The tilt plate (BA.21) can also be a part of the thruster. The function of this magnet (BA.23) is to attract the opposite magnet (SK.26) installed in the thruster (SK) thus enabling the immobility in the active position of thruster (SK).

The interchangeable tilt plate (BA.21) assures the proper tilt between the main axis of thruster (SK) and the diver's body axis while diving in the water. The appropriate tilt enables the diver linear movement along his/her body axis. If above-mentioned axes would be parallel, the torque over the transverse axis of a diver would appear due to the physical law of hydrodynamics. Consequently, the diver would slightly rotate around his/her transverse axis. The torque is the vector product of the pushing force and hydrodynamic resistant force of diver. Due to the significant differences of diver's heights, there are five tilt adapter plates (BA.21) in the set with different tilts. The diver has to install the appropriate interchangeable tilt plate (BA.21) depending on his/her height and diving style.

Two wires (not shown in FIG. 04) connect battery cells (not shown in FIG. 04) in the interchangeable battery pack (BA) with two spring contacts in the battery pack connector (BA.20). The wires are inserted in the channels of the adapter holder (BA.25) and battery pack connector (BA.20).

The battery pack connector (BA.20) is fixed with two screws (BA.26) to the adapter holder (BA.25). The spring contacts (not visible in FIG. 04) are inserted in the battery pack connector (BA.20). They both have different diameters to prevent the fault connection of contact clamp (SK) or thruster (SK) to the interchangeable battery pack (BA). The spring contacts assure the conductive connections with brass contact discs (SK.44 and SK.45) which are part of the contact cradles. These contact cradles are moved with (un) screwing along the hinge (SK.32) during the installation phase to inside receptively outside.

Command Joystick (UP)

The command joystick, which is connected via connection cable (PK) with the thruster (SK) is intended to be held in the diver's hand while diving. It enables the diver the controlling the scooter i.e. switching on by pressing the push button (UP.11). Consequently, the thruster (SK) rotates from the inactive position below the scuba dive tank (JE) to the active position above the scuba dive tank (JE). The same push button (UP.11) is used to manage the device when diver intends to dive with the device in the operating mode enabling the device to work only by holding the push button (UP.11). When diver releases the push button (UP.11) the device will stop running. By consecutive pressing the button (UP.16) the diver is able to switch-on or switch-off the device and thus selecting another mode of operation. In this mode, the device is running without permanent pressing any button.

By pressing the button (UP.15) the thruster (SK) rotates from the active position above the scuba dive tank (JE) to the inactive position below the scuba dive tank (JE). Once the thruster is in the inactive position the balls of spring plungers (BA.16) get stuck in the smaller hole of the locking plate (SK.20).

By rotating the rotation knob (UP.28) the diver is able to adjust the speed in both operation modes. Grooves on the assembly part (UP.26) and spring plunger with the ball (UP.29) enable six steps i.e. zero speed position (the device is not running) and five positions for five different speeds of running. Steps are marked on the assembly part (UP.21). The speed is actually regulated linear but six steps enable to diver easier control of the diving speed. When the spring plunger with the ball (UP.29) does not fit in any groove, its spring is compressed and when it fits in any of six holes its spring is released and the rotation knob (UP.28) stops in this position. There is a white mark on the rotation knob (UP.28) above the spring plunger with the ball (UP.29) which gives the diver information about the selected speed. When assembling the device this white mark is pasted into the rotation knob (UP.28). The rotation knob (UP.28) is fixed with the screw (UP.27) to the potentiometer shaft (UP.19).

Conical rubber washer (UP-02) and rubber o-rings (UP.04, UP.07, UP.13, UP.18, UP.20, UP.24, UP.25) assure the waterproof of command joystick (UP). The assembly parts (UP.21 and UP.26) are fixed with screws (UP.21). The potentiometer (UP.19) is fixed with the nut (UP.22) to the assembly part (UP.21). The electronic circuit (UP.09) controls the potentiometer (UP.19). The light conductor (UP.17) which provides information about the capacity of the interchangeable battery pack (BA) is inserted in the command joystick housing (UP.10).

Push buttons (UP.11, UP.15, UP.16) are screwed on the cradles (UP.14). Released springs (UP.12) assures that push buttons (UP.11, UP.15, UP.16) are in the upper position when not pressed. With pressing on those push buttons the springs get compressed and the cradles (UP.14) push the switches on the electronic circuit (UP.09).

The safety cord (UP.08) is intended to be placed around the diver's wrist and it assures the diver can't lose the command joystick even if he/she does not hold the command joystick in his/her hand. If due to any reason such as e.g. replacement of the diver's mask, helping another diver, taking underwater pictures or video, any other underwater activities, the safety cord (UP.08) assures that the diver can release the command joystick (UP) in any moment regardless either in running mode or still mode.

The lower cover of the command joystick housing (UP.05) and brass cable sleeve (UP.03) are fixed with the nut (UP.06). The latter is screwed with the brass cable nut (UP.01). The command joystick housing (UP.10) is fixed with screws with the lower cover of the command joystick housing (UP.05) and the upper cover of the command joystick housing (UP.21). Assembly parts (UP.01, UP.03, UP.06) are made of brass and protected with nickel coating. Assembly parts (UP.05, UP.10, UP.11, UP.15, UP.16, UP.21, UP.26, UP.28, UP.30) are made of aluminum or technical plastic. Cradles (UP.14), springs (UP.12) and spring plunger with the ball (UP.27) are made of stainless steel. The light conductor is made of the transparent acrylic glass.

Contact Clamp (KS)

Despite the contact clamp (KS) is not a component of the device used by the diver in the water, it may be required as an adapter between the standard connector of the battery charger available on the market and the charging connector of the interchangeable battery pack (BA). Connector (KS.01) is an appropriate standard connector, which is connected with a two-wire cable (KS.02) and via grommet (KS.03) installed in the dedicated hole in the contact clamp part (KS.04). The contact clamp part (KS.04) is fixed with two screws (KS.12) to the contact clamp part (KS.14). Conductors (KS.11) are inserted in contact clamp parts (KS.04, KS.10, KS.14, KS.15, KS.18) and connected with brass contacts (KS.16 and KS.17). The latter are screwed to the contact clamp parts (KS.15 and KS.18). The diameters of brass contacts (KS.16 and KS.17) are different to prevent the fault installation to the interchangeable battery pack (BA). Contact clamp part (KS.7, KS.10 and KS.14) are fixed with two screws (KS.05). There are two springs (KS.06) inserted in the holes of the contact clamp part (KS.07) along with the screws (KS.05). When the contact clamp (KS) is closed the springs (KS.06) are released (when the contact clamp (KS) is not used or when it is installed on the connector of the interchangeable battery pack (BA)). When assembling or disassembling the contact clamp (KS) to/from the interchangeable battery pack (BA) it is necessary to pull out the contact clamp part (KS.10). In this case springs (KS.06) are contracted and under pressure. When (dis)assembling the contact clamp (KS) to/from the interchangeable battery pack (BA) is performed, the springs (KS.06) are released again and push the contact clamp part (KS.10) back to its original position. Contact clamp parts (KS.04, KS.07, KS.09, KS.10, KS.14, KS.15, KS.18) are made of technical plastic, which does not conduct electrical current.

The invention claimed is:

1. An underwater scooter, for installing onto a scuba diving tank (JE), for use by a diver, the scooter comprising:
- a thruster (SK) including a motor, a propeller and a hinge;
- an interchangeable battery pack (BA) with the hinge mounted on said scuba diving tank (JE), wherein the thruster (SK) is movably mounted to the interchangeable battery pack (BA) with the hinge;
- a command joystick (UP) connected to the thruster (SK) with a cable, the motor being driven by said interchangeable battery pack (BA) and said command joystick (UP), for being held by the diver or attached to a diving suit of the diver,
- wherein the scooter is operable between two positions:
  - an active position, wherein the thruster (SK) is positioned axially out of line with an axis of the scuba diving tank (JE), and
  - an inactive position, wherein the thruster (SK) is positioned axially inline with the axis of the scuba diving tank (JE),
- wherein the position of the scooter can be changed with the command joystick (UP), so that the active position is achieved by movement of the propeller, as the propeller begins to push water away upon activation with the command joystick (UP), wherein the active position is locked with a locking mechanism.

2. The underwater scooter of claim 1, wherein the thruster (SK) moves around the hinge from the inactive position into the active position and vice versa only by a push force of the thruster caused by a propeller rotation.

3. The underwater scooter of claim 1, wherein the command joystick (UP) has two operation modes wherein the scooter is controlled by pressing and holding a push-button (UP.11), or by alternate pressing a push button (UP.16) to switch-on or switch-off the scooter.

4. The underwater scooter of claim 1, wherein the interchangeable battery pack (BA) is placed around the scuba dive tank (JE) at a bottom level so that a connection of the thruster (SK) and interchangeable battery pack (BA) is enabled in a rotating part of contact hinge (SK.32) and a fixed part of contact hinge (BA.20) without any additional cables outside the scooter.

5. The underwater scooter of claim 1, further comprising a contact hinge which comprises contact conductors, a hinge (SK.32) and a battery connector (BA.20), which connects the thruster (SK) and the interchangeable battery pack (BA), wherein an electrical connection between the thruster (SK) and the interchangeable battery pack (BA) provides a rotation of the thruster (SK) around a transversal axis in both directions between the two positions.

6. The underwater scooter of claim 1, further comprising a safety mechanism, which comprises a quick-release pin with a spring ball (BA.19), a locking part (BA.18), two screws (BA.17), two safety screws (BA.15) and two spring plungers with ball (BA.16) on the interchangeable battery pack (BA) and a bolt plate (SK.20) with two bolted holes and screws (SK.19) on the thruster (SK), the safety mechanism adapted to keep the scooter in the inactive position during transportation, storage in warehouse or preparation for use; and in that the quick release pin with the spring ball (BA.19) must be removed prior to use.

7. The underwater scooter of claim 1, wherein the scooter further comprises two stainless contacts inserted in a holder (SK.30) and connected with an electronic circuit of a motor controller, wherein water establishes an electrical circuit between the two stainless contacts, permitting operation of the scooter in water only.

8. The underwater scooter of claim 1, wherein locking mechanism further comprises shaped pins or screw balls in order to lock the position of the thruster (SK), as the pins or screw balls interlock in grooves provided in an adapter holder (BA.25) of the battery pack (BA), wherein a connection between the pins or screw balls can be released upon selecting an "inactivate" button on the command joystick (UP), when the motor starts to rotate in a opposite direction thereby forcing the pins or screw balls to leave the said grooves.

9. The underwater scooter of claim 1, further comprising an interchangeable tilt plate (BA.21), which in the active position assures an appropriate transversal angle between a driving part of the scooter, namely, the thruster (SK) and the scuba dive tank (JE).

10. The underwater scooter of claim 1, wherein the scooter can be used with standardized scuba dive tanks having a diameter 203 mm of different heights, volumes and capacities of the compressed air, and with standardized scuba dive tanks having a diameter 171 mm of different heights, volumes and capacities of the compressed air, wherein an adapter ring (BA.01) is placed between the interchangeable battery pack (BA) and the scuba dive tank having 171 mm diameter (JE).

11. The underwater scooter of claim 1, further comprising a contact clamp (KS) for use as a connector adapter for charging of the interchangeable battery pack (BA) with a suitable battery charger.

12. The underwater scooter of claim 1, wherein the thruster (SK) further comprises;

a brushless electric motor with a stator (SK.18) having, a circumference of copper coils (SK.17), a rotor ring (SK.16) with magnets (SK.15), installed inside the stator (SK.18), wherein said magnets (SK.15) are fixed to the rotor ring (SK.16) with fixing elements; and wherein the propeller (SK.09) is made of technical plastic and is fixed with screws (SK.08) and nuts (SK.13) via an aluminium ring (SK.12) to the rotor ring (SK.16);

ceramic bearings (SK.10) for assuring a bearing arrangement;

an axle (SK.11) made of stainless steel, placed in a centre hole of the propeller (SK.09); and an outside aluminium ring (SK.21) having protection covers (SK.06 and SK.22) made of aluminium.

13. The underwater scooter of claim 12, wherein the stator (SK.18) and the rotor ring (SK.16) comprise appropriate iron lamellas made of transformer sheet metal; and wherein in that the stator (SK.18) is protected with epoxy powder coating and the rotor ring (SK.16) is protected with the epoxy powder coating having a suitable thickness to prevent corrosion.

14. The underwater scooter of claim 1, wherein the battery pack (BA) comprises a housing with a battery pack cover (BA.04), a battery pack bottom (BA.12), rubber o-rings (BA.05, BA.06, BA.09, BA.10) for sealing housing of the interchangeable battery pack (BA), and a load-bearing ring (BA.11) made of aluminium and fixed to the battery pack bottom (BA.12) with screws (BA.13) for bearing a weight of the scuba diving tank, wherein the housing comprises an inner ring of battery pack (BA.07), an outer ring of battery pack (BA.08), the battery pack bottom (BA.12) and the battery pack cover (BA.04) and can be made of aluminium or technical plastic.

15. The underwater scooter of claim 1, wherein the command joystick (UP) comprises three push buttons (UP.11, UP.15, UP.16), a rotation knob (UP.28) for controlling a speed of the scooter, a potentiometer (UP.19) and conical rubber washer (UP.02) and rubber rings (UP.04, UP.07, UP13, UP18, UP20, UP24, UP25) to ensure the command joystick (UP) is waterproof.

* * * * *